US008519935B2

(12) United States Patent
Chen et al.

(10) Patent No.: US 8,519,935 B2
(45) Date of Patent: Aug. 27, 2013

(54) DISPLAY DEVICE WITH BI-DIRECTIONAL SHIFT REGISTERS

(75) Inventors: Yung-Chih Chen, Hsin-Chu (TW); Kuo-Chang Su, Hsin-Chu (TW); Chih-Ying Lin, Hsin-Chu (TW); Yu-Chung Yang, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 210 days.

(21) Appl. No.: 13/049,920

(22) Filed: Mar. 17, 2011

(65) Prior Publication Data

US 2012/0075275 A1 Mar. 29, 2012

(30) Foreign Application Priority Data

Sep. 29, 2010 (TW) ..... 99132997 A

(51) Int. Cl.
*G09G 3/36* (2006.01)

(52) U.S. Cl.
USPC ..... 345/100; 377/64; 377/69

(58) Field of Classification Search
USPC ..... 377/64–81; 345/100, 204–206, 345/208–210, 87–93; 349/144
See application file for complete search history.

(56) References Cited

U.S. PATENT DOCUMENTS 3,108,228 A * 10/1963 Clapper ..... 327/160
3,577,086 A * 5/1971 Kliman et al. ..... 327/269
6,621,886 B2 * 9/2003 Kawahata ..... 377/1
7,400,306 B2 * 7/2008 Hu ..... 345/1.3
7,453,429 B2 * 11/2008 Chang et al. ..... 345/89
8,159,444 B2 * 4/2012 Go ..... 345/100
8,179,349 B2 * 5/2012 Liao et al. ..... 345/89
2007/0248204 A1 * 10/2007 Tobita ..... 377/64
2008/0001899 A1 * 1/2008 Chan et al. ..... 345/100
2008/0266477 A1 * 10/2008 Lee et al. ..... 349/46
2008/0316413 A1 * 12/2008 Cho ..... 349/144
2009/0085853 A1 * 4/2009 Um et al. ..... 345/92
2009/0115772 A1 * 5/2009 Shiomi et al. ..... 345/214
2009/0225018 A1 * 9/2009 Kim ..... 345/90
2010/0118012 A1 * 5/2010 Irie et al. ..... 345/211
2010/0201666 A1 * 8/2010 Tobita ..... 345/208
2010/0220116 A1 * 9/2010 Liao et al. ..... 345/690
2010/0315321 A1 * 12/2010 Huang et al. ..... 345/92
2011/0148830 A1 * 6/2011 Hsu et al. ..... 345/205

OTHER PUBLICATIONS

Hsu, "Gate Driving Circuit", TW application No. 098143397, filed on Dec. 17, 2009.

* cited by examiner

*Primary Examiner* — Alexander Eisen
*Assistant Examiner* — Sanjiv D Patel
(74) *Attorney, Agent, or Firm* — Winston Hsu; Scott Margo

(57) ABSTRACT

A display device having bi-directional shift registers is disclosed. The display device includes a display panel, a first dummy shift register set, a second dummy shift register set, a third dummy shift register sets, a fourth dummy shift register sets, a first valid shift register set coupled between the first dummy shift register set and the second dummy shift register set, a second valid shift register set coupled between the third dummy shift register set and the fourth dummy shift register set, and a first directional circuit coupled to a first valid register in the first valid register set and the third dummy shift register set.

26 Claims, 8 Drawing Sheets

DISPLAY DEVICE WITH BI-DIRECTIONAL SHIFT REGISTERS

BACKGROUND OF THE INVENTION

1. Field of the Invention

The present invention is related to a display device, and more particularly, to a display device having bi-directional shift registers.

2. Description of the Prior Art

Many techniques have been developed in order to improve poor viewing angle of large-size liquid crystal display (LCD) devices, such as multi-domain vertical alignment (MVA) and in-plane switching (IPS). For an LCD device which operates in MVA mode, color washout is a major drawback in display quality.

FIG. 1 is a diagram illustrating a prior art pixel 100 capable of improving color washout. As well-known to those skilled in the art, the pixels of an LCD device are arranged as a matrix. FIG. 1 depicts partial structure of the pixel 100, which includes a main gate line GL, a sub gate line GL', a data line DL, a first thin film transistor switch T1, a second thin film transistor switch T2, a third thin film transistor switch T3, a first liquid crystal capacitor Clc1, a second liquid crystal capacitor Clc2, a first storage capacitor Cst1, a second storage capacitor Cst2, and a third storage capacitor Cst3. The first liquid crystal capacitor Clc1 and the first storage capacitor Cst1 are coupled to the drain of the first thin film transistor switch T1 (denoted by a node p1). The second liquid crystal capacitor Clc2 and the second storage capacitor Cst2 are coupled to the drain of the second thin film transistor switch T2 (denoted by a node p2). The third storage capacitor Cst3 is coupled to the drain of the third thin film transistor switch T3. The gates of the first thin film transistor switch T1 and the second thin film transistor switch T2 are coupled to the gate line GL, and the sources of the first thin film transistor switch T1 and the second thin film transistor switch T2 are coupled to the data line DL. The drain of the second thin film transistor switch T2 is coupled to the source of the third thin film transistor switch T3, and the gate of the third thin film transistor switch T3 is coupled to the sub gate line GL'. When the main gate line GL is at high level, the first thin film transistor switch T1 and the second thin film transistor switch T2 are both turned on for writing display voltages, and the nodes p1 and p2 are both at the level of the display voltages. Next, when the main gate line GL is lowered to low level and the sub gate line GL' is raised to high level, the third thin film transistor switch T3 is turned on and charge sharing occurs between the third storage capacitor Cst3 and the display voltages which are stored in the first thin film transistor switch T1 and the second thin film transistor switch T2. Thus, a voltage difference established between the nodes p1 and p2 changes according to the third storage capacitor Cst3, thereby improving color washout.

On the other hand, in order to utilize larger panel area and reduce material costs, GOA (gate driver on array) technique has been developed in which the level shifters and shift registers of driving ICs are integrated in the substrate of the LCD panel. Although the pixel 100 in FIG. 1 is widely used in large-size LCD panels for improving color washout, it does not work with bi-directional shift registers.

FIG. 2 is a diagram illustrating a prior art bi-directional driving structure. For the first column of pixel units PX1-PXm each having the same structure as the pixel 100, two scan circuits are required for providing precharge and bi-directional scan: when the shift registers SR_1-SR_m performs forward-scan in a top-to-bottom sequence, the pixels are charged first and then perform precharge; when the shift registers SR_m-SR_1 performs reverse-scan in a bottom-to-top sequence, the pixels are charged after performing precharge. Therefore, the shift registers may not function correctly.

SUMMARY OF THE INVENTION

The present invention also provides display device including a display panel having N main gate lines and N sub gate lines; a first dummy shift register set; a second dummy shift register set; a third dummy shift register sets; a fourth dummy shift register set, wherein each dummy shift register sets includes m dummy shift registers; a first bi-directional shift register set, a second bi-directional shift register set, and a first directional start pulse signal generator. The first bi-directional shift register set is coupled between the first dummy shift register set and the second dummy shift register set and includes L bi-directional shift registers, wherein a first bi-directional shift register in the first bi-directional shift register set is coupled to the first dummy shift register set, an $L^{th}$ bi-directional shift register in the first bi-directional shift register set is coupled to the second dummy shift register set, an output end of a $k^{th}$ bi-directional shift register in the first bi-directional shift register set is coupled to a $(k+m)^{th}$ main gate line which is coupled to an input end of a $(k+1)^{th}$ bi-directional shift register in the first bi-directional shift register set. The second bi-directional shift register set is coupled between the third dummy shift register set and the fourth dummy shift register set and includes L bi-directional shift registers, wherein a first bi-directional shift register in the second bi-directional shift register set is coupled to the third dummy shift register set, an $L^{th}$ bi-directional shift register in the second bi-directional shift register set is coupled to the fourth dummy shift register set, an output end of a $k^{th}$ bi-directional shift register in the second bi-directional shift register set is coupled to a $(k+m)^{th}$ sub gate line which is coupled to an input end of a $(k+1)^{th}$ bi-directional shift register in the second bi-directional shift register set. The first directional start pulse signal generator is coupled to the first bi-directional shift register in the first bi-directional shift register set for enabling a $(1+m)^{th}$ main gate line by outputting a first start pulse signal, and is coupled to the $(1+m-c)^{th}$ dummy shift register in the third dummy shift register set for enabling a $(1+m-c)^{th}$ sub gate line by outputting the first start pulse signal, wherein $N>L>k$ and $m \geqq c$.

The present invention also provides a display device including a display panel having N main gate lines and N sub gate lines; a first dummy shift register set; a second dummy shift register set; a third dummy shift register set; a fourth dummy shift register set, wherein each dummy shift register set includes m dummy shift registers; a first bi-directional shift register set, a second bi-directional shift register set, and a first directional start pulse signal generator. The first bi-directional shift register set is coupled between the first dummy shift register set and the second dummy shift register set and includes L bi-directional shift registers, wherein a first bi-directional shift register in the first bi-directional shift register set is coupled to the first dummy shift register set, an $L^{th}$ bi-directional shift register in the first bi-directional shift register set is coupled to the second dummy shift register set, an output end of a $k^{th}$ bi-directional shift register in the first bi-directional shift register set is coupled to a $(k+m)^{th}$ main gate line which is coupled to an input end of a $(k+1)^{th}$ bi-directional shift register in the first bi-directional shift register set. The second bi-directional shift register set is coupled between the third dummy shift register set and the fourth dummy shift register set and includes L bi-directional shift registers, wherein a first bi-directional shift register in the second set of bi-directional shift registers is coupled to the third dummy shift register set, an $L^{th}$ bi-directional shift register in the second bi-directional shift register set is coupled to the fourth dummy shift register set, an output end of a $k^{th}$ bi-directional shift register in the second set of bi-directional shift registers is coupled to a $(k+m)^{th}$ sub gate line which is coupled to an input end of a $(k+1)^{th}$ bi-directional shift register in the second bi-directional shift register set. The first directional start pulse signal generator is coupled to a $j^{th}$ bi-directional shift register in the first bi-directional shift register set for enabling a $j^{th}$ main gate line by outputting a first start pulse signal, and is coupled to a $(j-c)^{th}$ dummy shift register in the third dummy shift register set for enabling a $(j-c)^{th}$ sub gate line by outputting the first start pulse signal, wherein $N>L>k$, $m \geqq j>c$, and $j \neq 1$.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
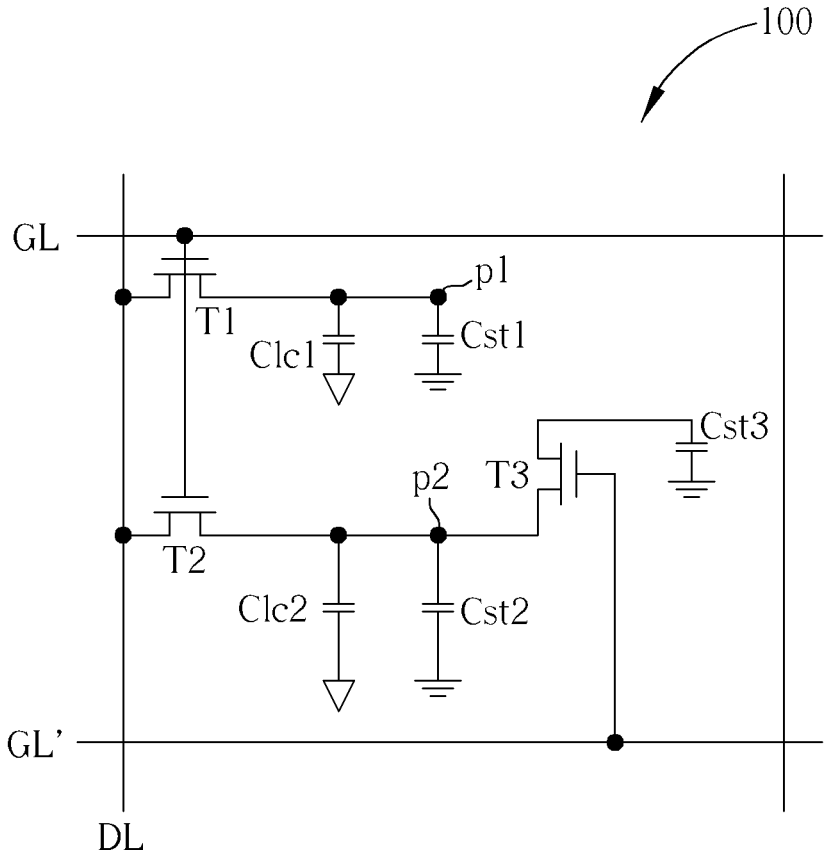
FIG. 1 PRIOR ART
FIG. 1 is a diagram illustrating a prior art pixel capable of improving color washout.
Figure 2:
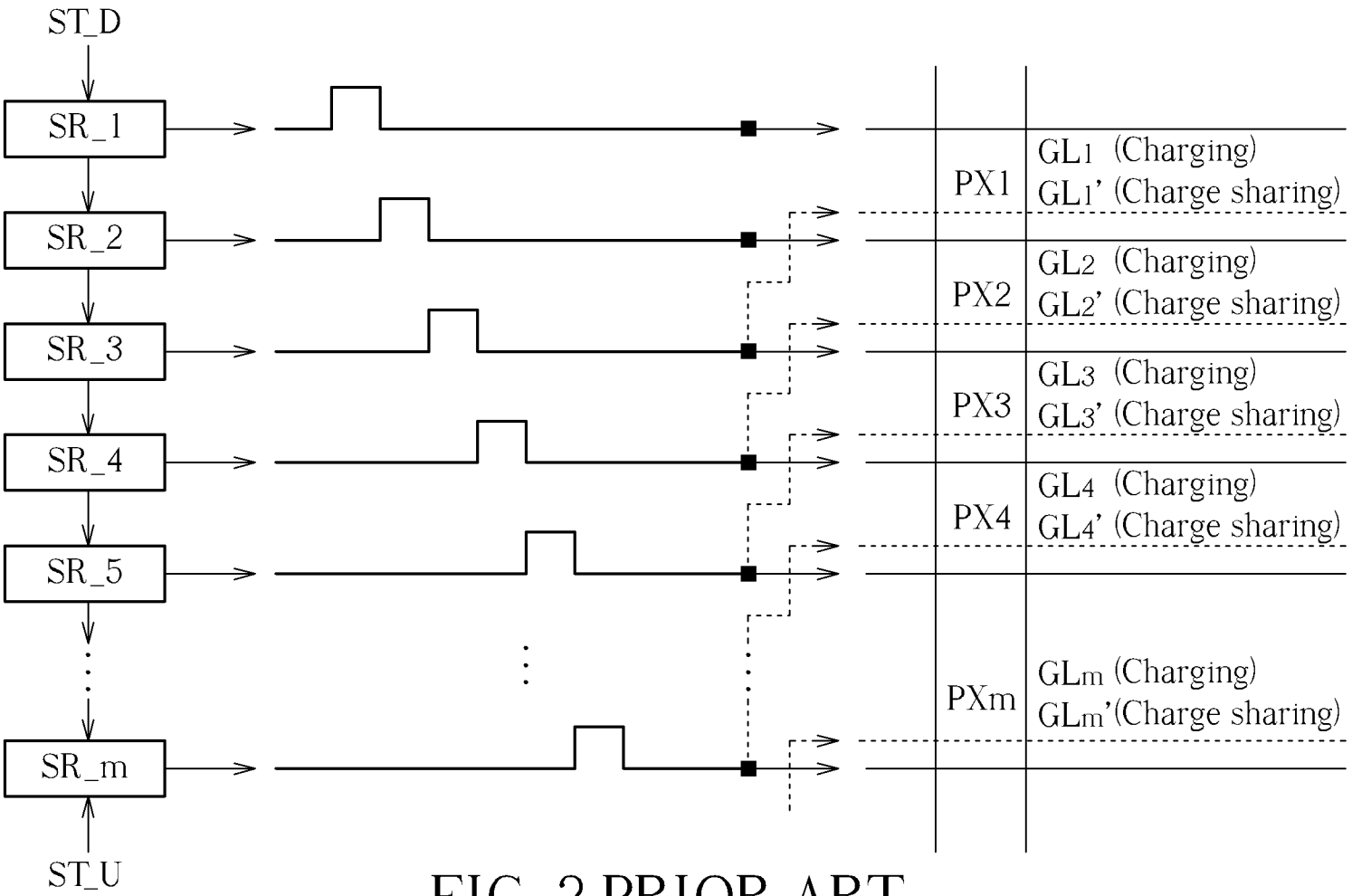
FIG. 2 PRIOR ART
FIG. 2 is a diagram illustrating a prior art bi-directional driving structure.
Figure 3:
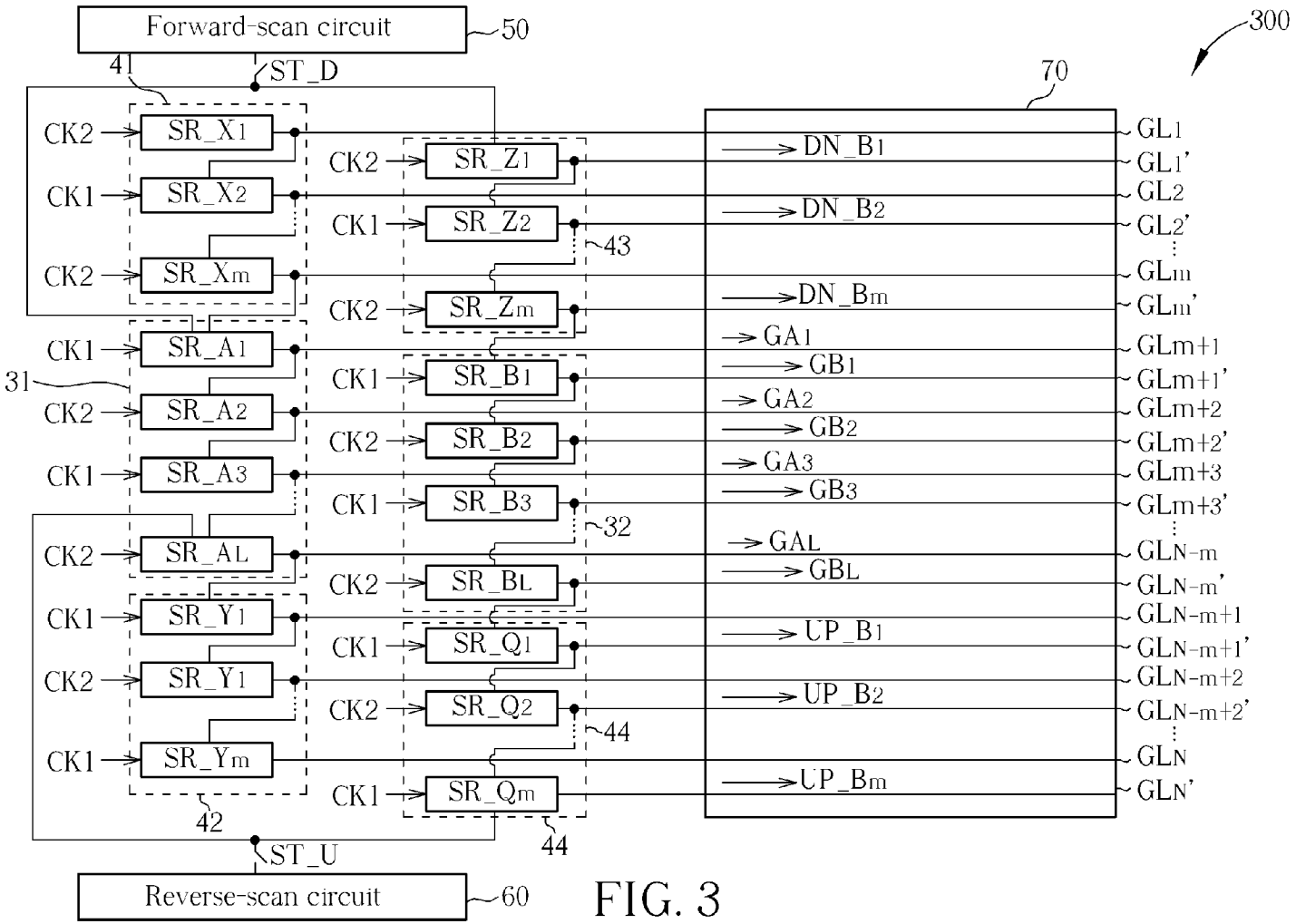
FIGS. 3 and 5 are diagrams illustrating display devices with a bi-directional scanning structure according to the embodiments of the present invention.

FIG. 3 is a diagram illustrating a display device 300 with a bi-directional scanning structure according to a first embodiment of the present invention. The display device 300 includes two valid shift register sets 31-32, four dummy shift register sets 41-44, N main gate lines $GL_1$-$GL_N$, N sub gate lines $GL_1'$-$GL_N'$, a forward-scan circuit 50, a reverse-scan circuit 60, and a display region 70. The display region 70 may adopt the pixel structure as depicted in FIG. 1, which, however, does not limit the scope of the present invention. In the display device 300 according to the first embodiment of the present invention, the pixels in the display region 70 are charged by the dummy shift register sets 41-42 and the valid shift register set 31, while the sub gate lines are driven by the dummy shift register sets 43-44 and the valid shift register set 32 in order to perform charge sharing, thereby improving color washout.

The dummy shift register set 41 includes m shift registers $SR_X_1$-$SR_X_m$ having output ends respectively coupled to main gate lines $GL_1$-$GL_m$ and corresponding shift registers of the next stage. The valid shift register set 31 includes L bi-directional shift registers $SR_A_1$-$SR_A_L$ having output ends respectively coupled to main gate lines $GL_{m+1}$-$GL_{N-m}$ (also denoted as $GL_{m+L}$) and corresponding bi-directional shift registers of the next stage, wherein $N=L+2m$. In the dummy shift register sets 41 and 42, the shift registers $SR_X_1$-$SR_X_m$ and $SR_Y_1$-$SR_Y_m$ may be uni-directional or bi-directional shift registers.

The dummy shift register set 43 includes m shift registers $SR_Z_1$-$SR_Z_m$ having output ends respectively coupled to sub gate lines $GL_1'$-$GL_m'$ and corresponding shift registers of the next stage. The valid shift register set 32 includes L bi-directional shift registers $SR_B_1$-$SR_B_L$ having output ends respectively coupled to sub gate lines $GL_{m+1}'$-$GL_{N-m}'$ (also denoted as $GL_{m+L}'$) and corresponding bi-directional shift registers of the next stage. The dummy shift register set 44 includes m shift registers $SR_Q_1$-$SR_Q_m$ having output ends respectively coupled to sub gate lines $GL_{N-m+1}'$-$GL_N'$ and corresponding shift registers of the next stage. In the dummy shift register sets 43 and 44, the shift registers $SR_Z_1$-$SR_Z_m$ and $SR_Q_1$-$SR_Q_m$ may be uni-directional or bi-directional shift registers.

The forward-scan circuit 50 is configured to output a forward-scan start pulse signal ST_D to the $1^{st}$-stage bi-directional shift register $SR_A_1$ in the valid shift register set 31 and the $1^{st}$-stage shift register $SR_Z_1$ in the dummy shift register set 43. The reverse-scan circuit 60 is configured to output a reverse-scan start pulse signal ST_U to the $L^{th}$-stage bi-directional shift register $SR_A_L$ in the valid shift register set 31 and the $m^{th}$-stage shift register $SR_Q_m$ in the dummy shift register set 44. The forward-scan circuit 50 and the reverse-scan circuit 60 may control the operational mode of the display device 300: in response to the forward-scan start pulse signal ST_D, the display device 300 operates in a forward-scan mode in which the pixels in the display region 70 are sequentially scanned in a top-to-bottom sequence; in response to the reverse-scan start pulse signal ST_U, the display device 300 operates in a reverse-scan mode in which the pixels in the display region 70 are sequentially scanned in a bottom-to-top sequence.

Figure 4A:
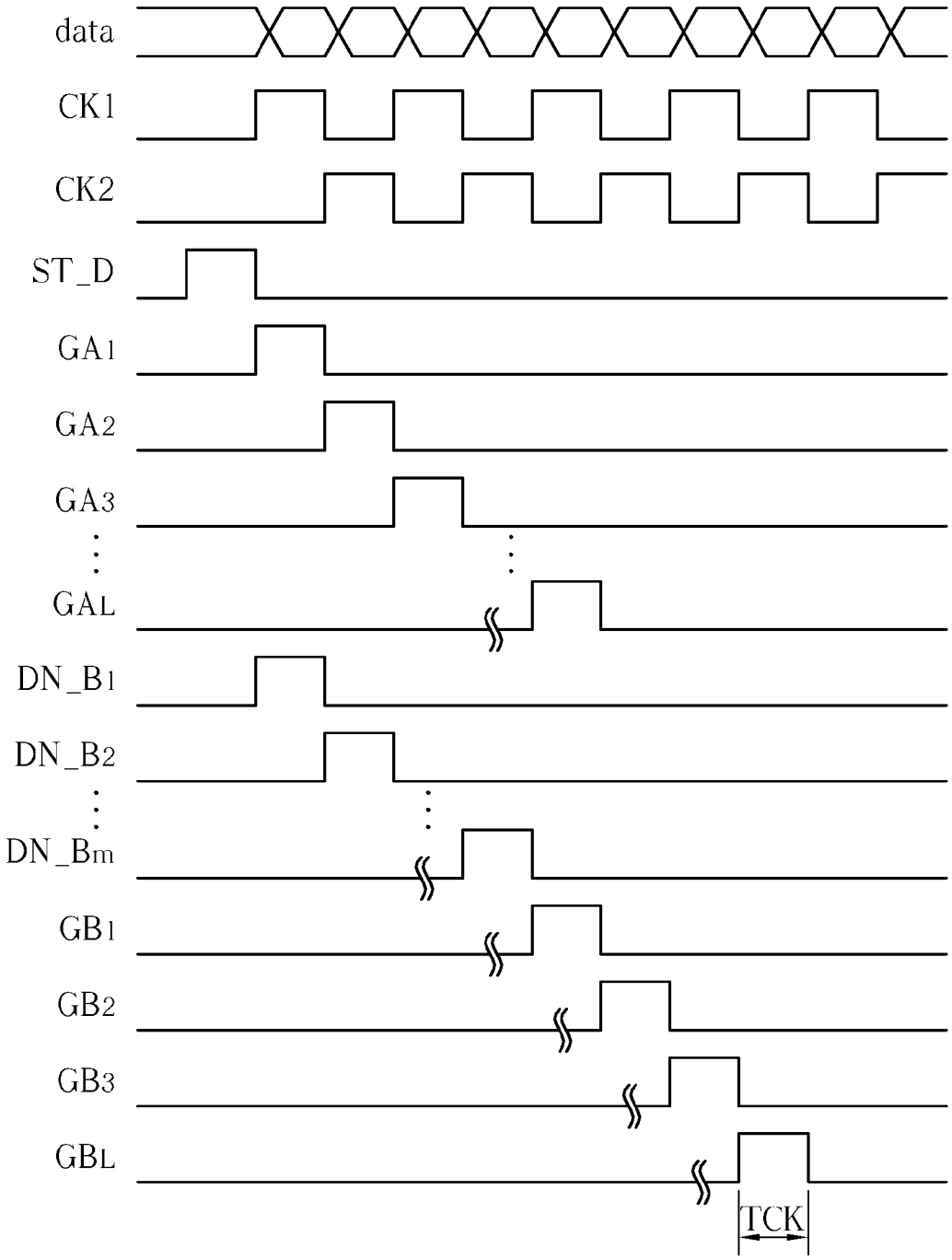
FIGS. 4A and 6A are timing diagrams illustrating the operations of the display devices in the forward-scan mode according to the embodiments of the present invention.

FIG. 4A is a timing diagram illustrating the operation of the display device 300 in the forward-scan mode. After receiving the forward-scan start pulse signal ST_D, the bi-directional shift registers $SR_A_1$-$SR_A_L$ sequentially output gate driving signals $GA_1$-$GA_L$ to the corresponding main gate lines $GL_{m+1}$-$GL_{N-m}$ according to the clock signal CK1 or CK2, while the shift registers $SR_Z_1$-$SR_Z_m$ and the bi-directional shift registers $SR_B_1$-$SR_B_L$ sequentially output delay signals $DN_B_1$-$DN_B_m$ and charge-sharing signals $GB_1$-$GB_L$ to the corresponding sub gate lines $GL_1'$-$GL_{N-m}'$ according to the clock signal CK1 or CK2. As depicted in FIG. 3, the $k^{th}$ (k is an integer between 1 and L) pixel row coupled to the $k^{th}$ main gate line $GL_{m+k}$ and the $k^{th}$ sub gate line $GL_{m+k}'$ is charged by the gate driving signal $GA_k$ and performs charge sharing according to the charge-sharing signal $GB_k$. When the display device 300 operates in the forward-scan mode, the dummy shift register set 43 generates the delay signals $DN_B_1$-$DN_B_m$ in order to delay the gate driving signals $GA_1$-$GA_L$ with respect to the corresponding charge-sharing signals $GB_1$-$GB_L$, such as by an amount of m*TCK.

Figure 4B:
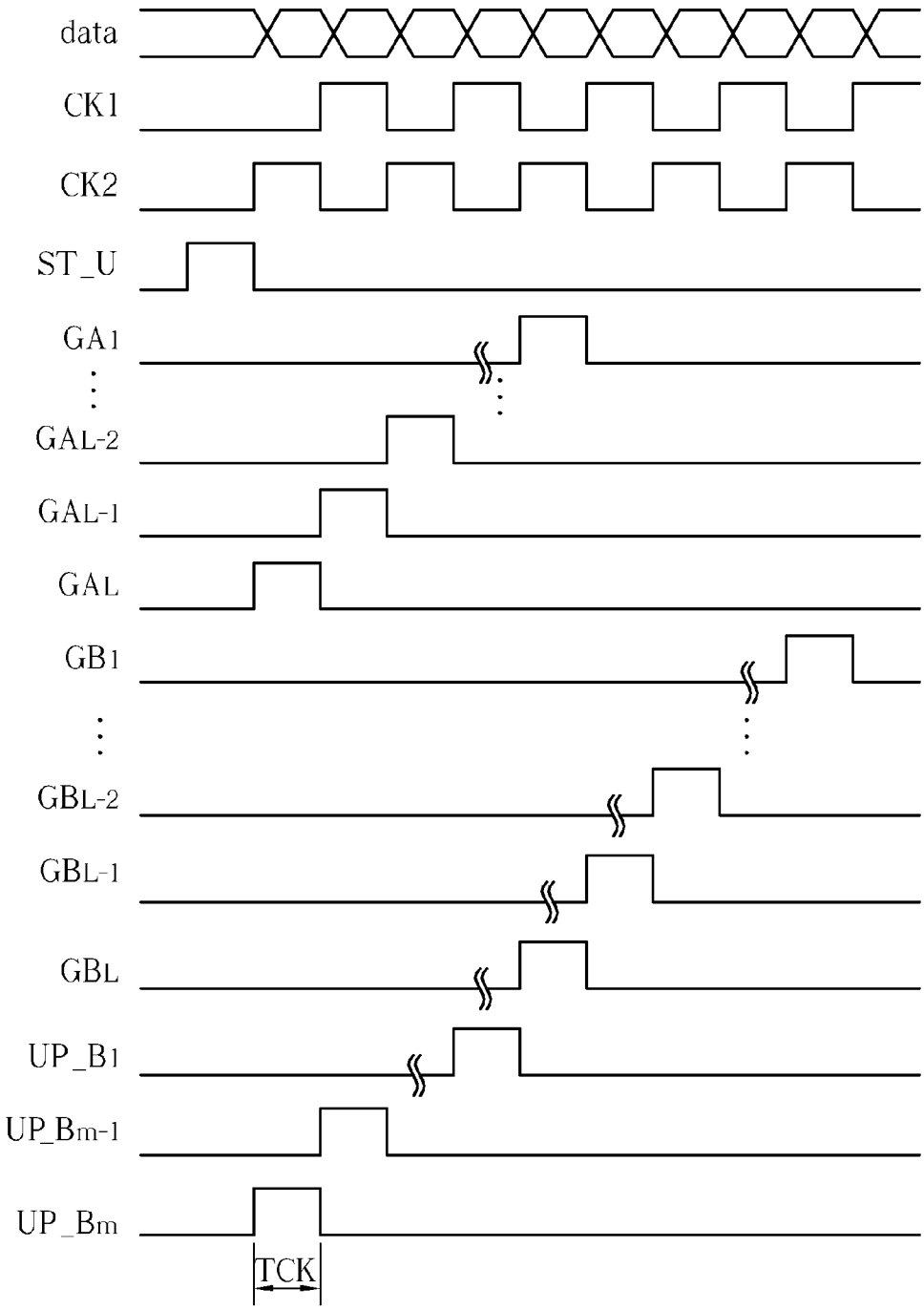
FIGS. 4B and 6B are timing diagrams illustrating the operations of the display devices in the reverse-scan mode according to the embodiments of the present invention.

FIG. 4B is a timing diagram illustrating the operation of the display device 300 in the reverse-scan mode. After receiving the reverse-scan start pulse signal ST_U, the bi-directional shift registers $SR_A_L$-$SR_A_1$ sequentially output the gate driving signals $GA_L$-$GA_1$ to the corresponding main gate lines $GL_{N-m}$-$GL_{m+1}$ according to the clock signal CK1 or CK2, while the shift registers $SR_Q_1$-$SR_Q_m$ and the bi-directional shift registers $SR_B_L$-$SR_B_1$ sequentially output delay signals $UP_B_m$-$UP_B_1$ and the charge-sharing signals $GB_L$-$GB_1$ to the corresponding sub gate lines $GL_N'$-$GL_{m+1}'$ according to the clock signal CK1 or CK2. When the display device 300 operates in the reverse-scan mode, the dummy shift register set 44 generates the delay signals $UP_B_m$-

$UP_B_1$ in order to delay the gate driving signals $GA_L$-$GA_1$ with respect to the corresponding charge-sharing signals $GB_L$-$GB_1$, such as by an amount of m*TCK. In both the forward-scan mode and the reverse-scan mode, the display device 300 charges the pixels first and then performs charge sharing.

Figure 5:
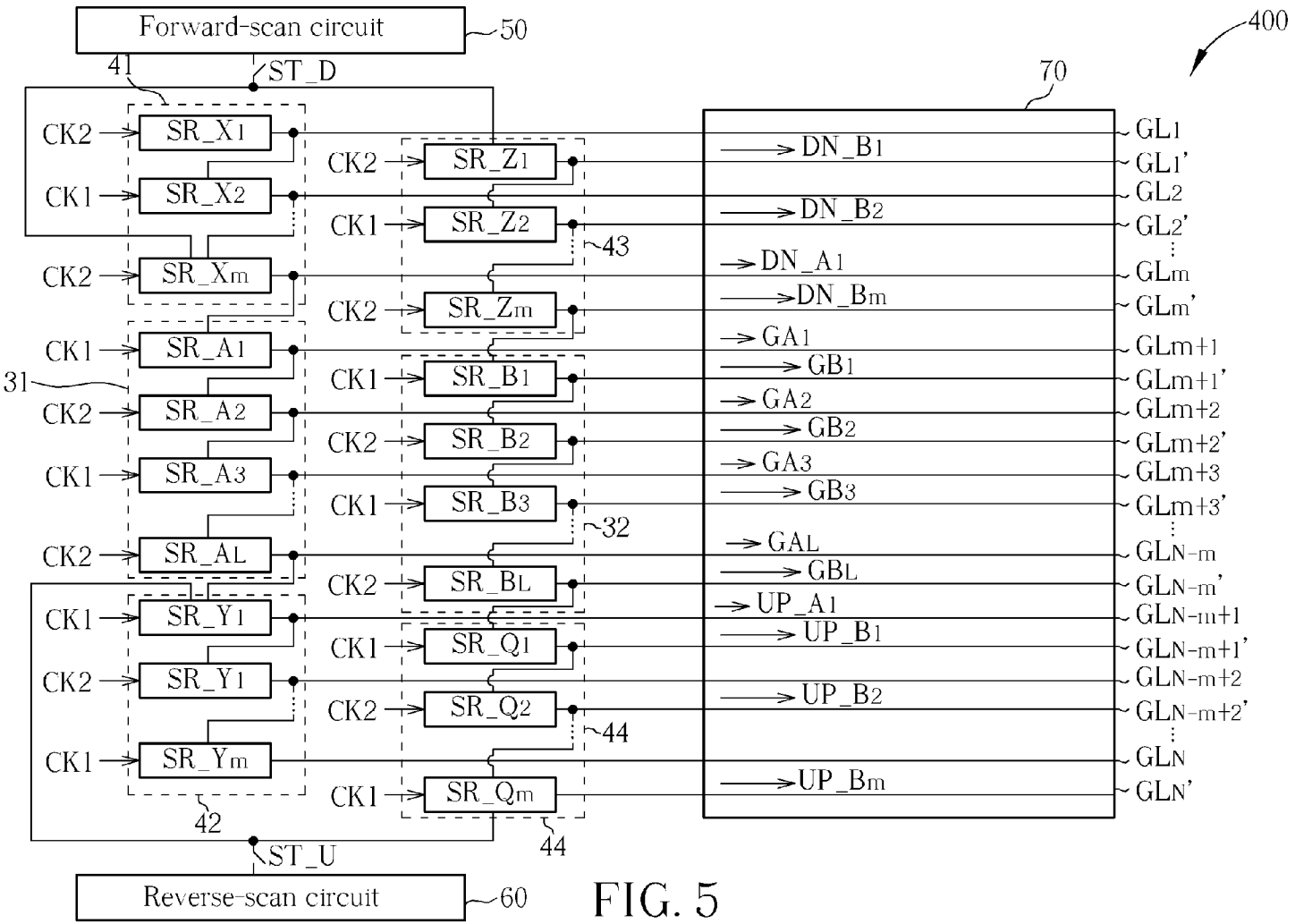

FIG. 5 is a diagram illustrating a display device 400 with a bi-directional scanning structure according to a second embodiment of the present invention. Similar to the display device 300, the display device 400 also includes two valid shift register sets 31-32, four dummy shift register sets 41-44, N main gate lines $GL_1$-$GL_N$, N sub gate lines $GL_1'$-$GL_N'$, a forward-scan circuit 50, a reverse-scan circuit 60, and a display region 70. The forward-scan circuit 50 is also configured to output a forward-scan start pulse signal ST_D to the $1^{st}$-stage shift register $SR_Z_1$ in the dummy shift register set 43 and the reverse-scan circuit 60 is also configured to output a reverse-scan start pulse signal ST_U to the $m^{th}$-stage shift register $SR_Q_m$ in the dummy shift register set 44. However, in the display device 400 according to the second embodiment of the present invention, the forward-scan circuit 50 is configured to output the forward-scan start pulse signal ST_D to the $j^{th}$-stage shift register $SR_Z_j$ ($1<j\leqq m$) in the dummy shift register set 41 and the reverse-scan circuit 60 is configured to output the reverse-scan start pulse signal ST_U to the $(m-j+1)^{th}$-stage shift register $SR_Z_{m-j+1}$ ($1<j\leqq m$) in the dummy shift register set 42. FIG. 5 is an embodiment when j=m.

Figure 6A:
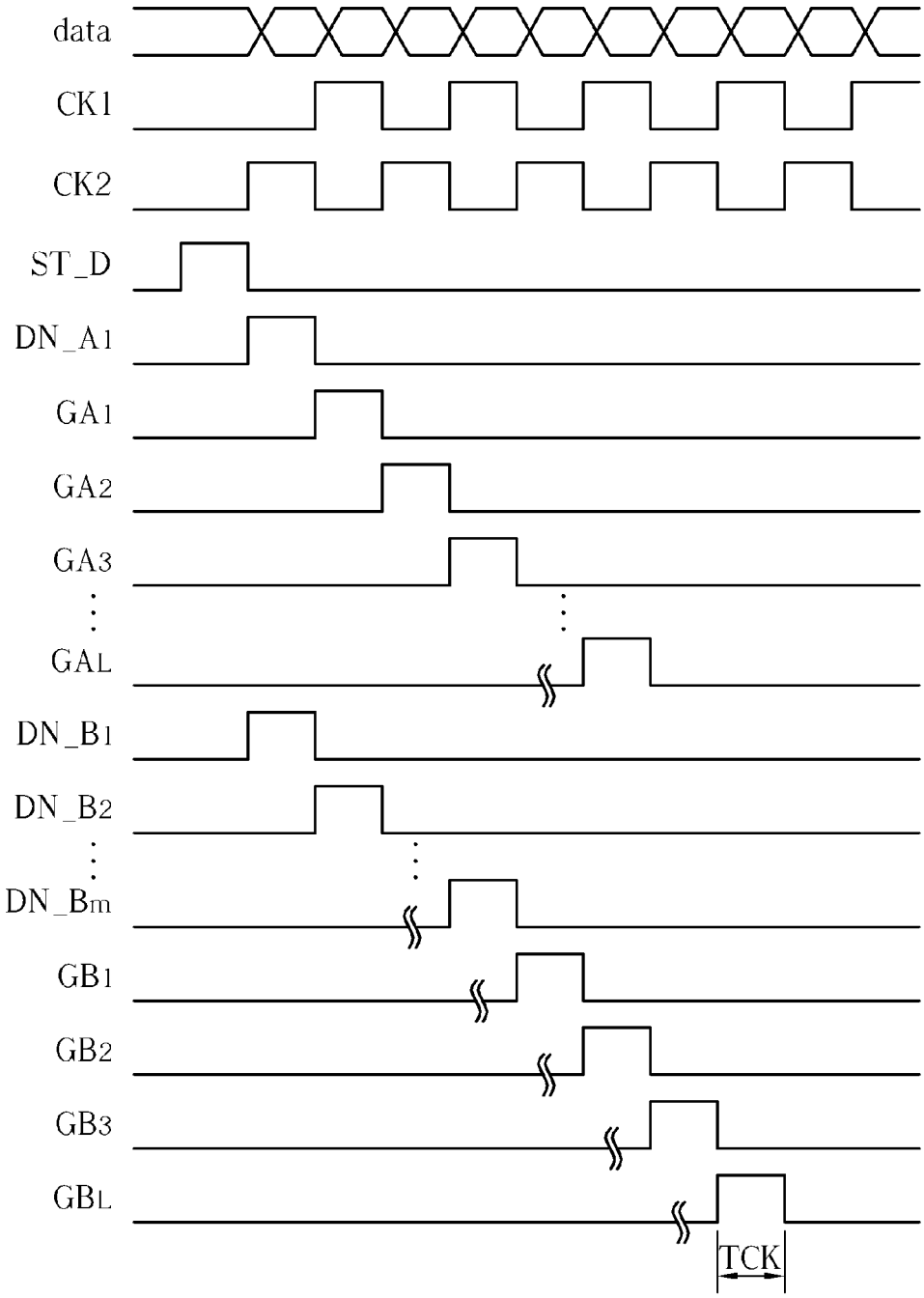

FIG. 6A is a timing diagram illustrating the operation of the display device 400 in the forward-scan mode. After receiving the forward-scan start pulse signal ST_D, the $m^{th}$-stage shift register $SR_X_m$ in the dummy shift register set 41 and the bi-directional shift registers $SR_A_1$-$SR_A_L$ sequentially output a delay signal $DN_A_1$ and the gate driving signals $GA_1$-$GA_L$ to the corresponding main gate lines $GL_1$-$GL_{N-m}$ (also denoted as $GL_{m+L}'$) according to the clock signal CK1 or CK2, and the shift registers $SR_Z_1$-$SR_Z_m$ and the bi-directional shift registers $SR_B_1$-$SR_B_L$ sequentially output delay signals $DN_B_1$-$DN_B_m$ and the charge-sharing signals $GB_1$-$GB_L$ to the corresponding sub gate lines $GL_1'$-$GL_{N-m}'$ (also denoted as $GL_{m+L}'$) according to the clock signal CK1 or CK2. When the display device 400 operates in the forward-scan mode, the $m^{th}$-stage shift register $SR_X_m$ in the dummy shift register set 41 generates the delay signal $DN_A_1$ in order to delay the gate driving signals $GA_1$-$GA_L$, while the dummy shift register set 43 generates the delay signal $DN_B_1$-$DN_B_m$ in order to delay the charge-sharing signals $GB_1$-$GB_L$. Therefore, the gate driving signals $GA_1$-$GA_L$ may be delayed with respect to the corresponding charge-sharing signals $GB_1$-$GB_L$, such as by an amount of (m−1)*TCK.

Figure 6B:
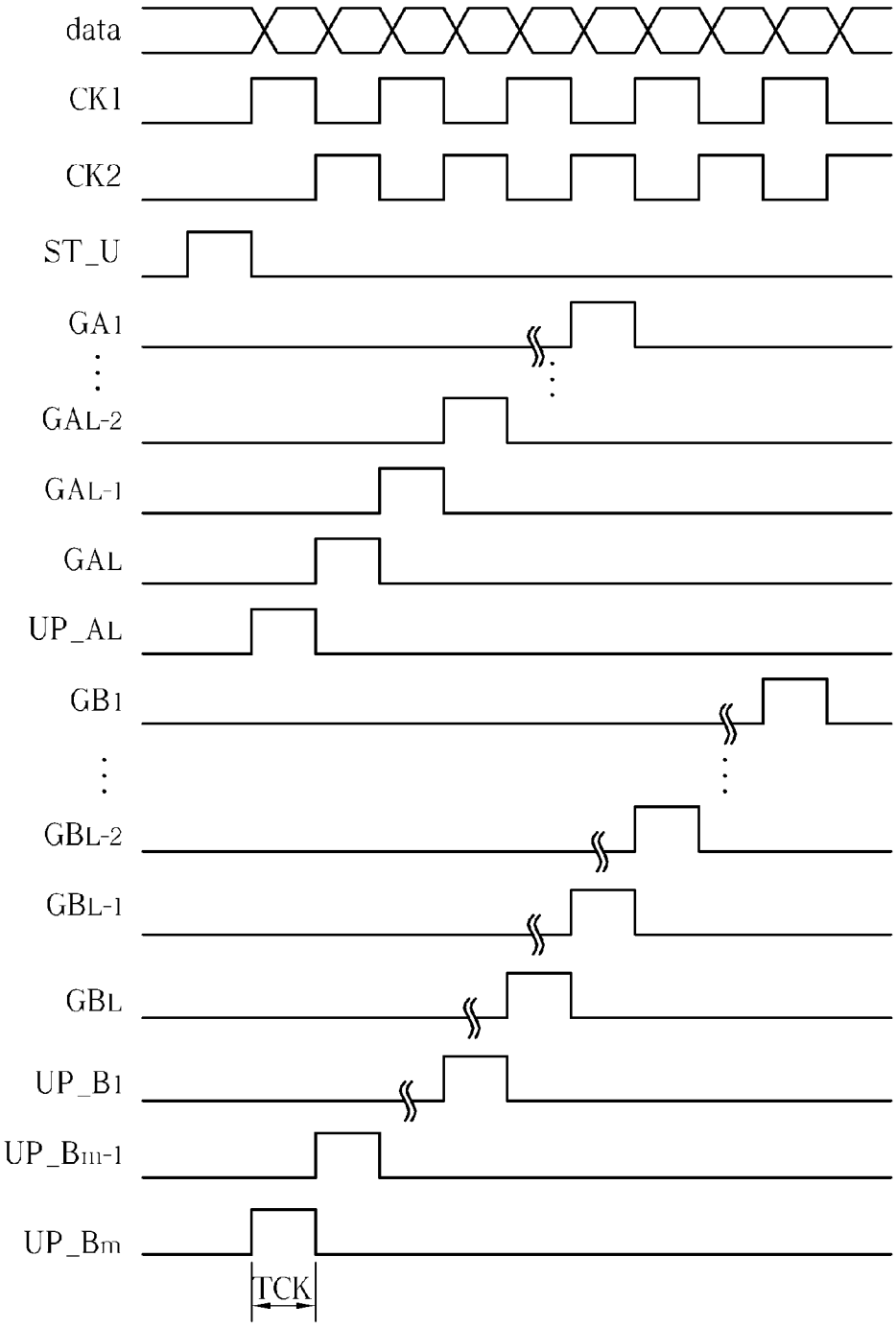

FIG. 6B is a timing diagram illustrating the operation of the display device 400 in the reverse-scan mode. After receiving the reverse-scan start pulse signal ST_U, the $1^{st}$-stage shift register $SR_Y_1$ in the dummy shift register set 42 and the bi-directional shift registers $SR_A_L$-$SR_A_1$ sequentially output the delay signal $DN_A_1$ and the gate driving signals $GA_L$-$GA_1$ to the corresponding main gate lines $GL_{N-m+1}$-$GL_{m+1}$ according to the clock signal CK1 or CK2, while the shift registers $SR_Q_m$-$SR_Q_1$ and the bi-directional shift registers $SR_B_L$-$SR_B_1$ sequentially output the delay signal $UP_B_m$-$UP_B_1$ and the charge-sharing signals $GB_L$-$GB_1$ to the corresponding sub gate lines $GL_N'$-$GL_{m+1}'$ according to the clock signal CK1 or CK2. When the display device 400 operates in the reverse-scan mode, the $1^{st}$-stage shift register $SR_Y_1$ in the dummy shift register set 42 generates a delay signal $UP_A_1$ in order to delay the gate driving signals $GA_L$-$GA_1$, while the dummy shift register set 44 generates the delay signals $DN_B_m$-$DN_B_1$ in order to delay the charge-sharing signals $GB_L$-$GB_1$. Therefore, the gate driving signals $GA_L$-$GA_1$ may be delayed with respect to the corresponding charge-sharing signals $GB_L$-$GB_1$, such as by an amount of (m−1)*TCK. In both the forward-scan mode and the reverse-scan mode, the display device 400 charges the pixels first and then performs charge sharing.

In other embodiments of the present invention, the forward-scan circuit 50 may output the forward-scan start pulse signal ST_D to the $j^{th}$-stage shift register $SR_X_j$ in the dummy shift register set 41 and the $(j-c)^{th}$-stage shift register $SR_Z_{(j-c)}$ in the dummy shift register set 43, while the reverse-scan circuit 60 may output the reverse-scan start pulse signal ST_U to the $a^{th}$-stage shift register $SR_Z_a$ in the dummy shift register set 42 and the $(a+c')^{th}$-stage shift register $SR_Q_{(a+c)}$ in the dummy shift register set 44, wherein $N>L>k$, $m\geqq j>c$, $m\geqq c'$, $m\geqq a$, $m\geqq a+c$, and $j\neq 1$. Meanwhile, in the dummy shift register set 41, the $1^{st}$ to $(j-1)^{th}$-stage shift register $SR_X_1$-$SR_X_{(j-1)}$ may be uni-directional or bi-directional shift registers, while the $j^{th}$ to $m^{th}$-stage shift register $SR_X_j$-$SR_X_m$ are bi-directional shift registers. In the dummy shift register set 42, the $1^{st}$ to $a^{th}$-stage shift register $SR_Y_1$-$SR_Y_a$ are bi-directional shift registers, while the $(a+1)^{th}$ to $m^{th}$-stage shift register $SR_Y_{(a+1)}$-$SR_Y_m$ may be uni-directional or bi-directional shift registers. In the dummy shift register set 43, the $1^{st}$ to $(j-c-1)^{th}$-stage shift register $SR_Z_1$-$SR_Z_{(j-c-1)}$ may be uni-directional or bi-directional shift registers, while the $(j-c)^{th}$ to $m^{th}$-stage shift register $SR_Z_{(j-c)}$-$SR_Z_m$ are bi-directional shift registers. In the dummy shift register set 44, the $1^{st}$ to $(a+c')^{th}$-stage shift register $SR_Q_1$-$SR_Z_{(a+c')}$ are bi-directional shift registers, while the $(a+c'+1)^{th}$ to $m^{th}$-stage shift register $SR_Q_{(a+c'+1)}$-$SR_Q_m$ may be uni-directional or bi-directional shift registers.

In the present invention, a certain amount of delay is provided between the gate driving signals for charging the pixels and the corresponding charge-sharing signals for performing charge sharing according to the scan sequence. Therefore, the gate driving signals and the corresponding charge-sharing signals are not overlapped in both the forward-scan mode and the reverse-scan mode, thereby allowing correct operation.

Those skilled in the art will readily observe that numerous modifications and alterations of the device and method may be made while retaining the teachings of the invention.

What is claimed is:

1. A display device comprising:

a display panel having:

N main gate lines and N sub gate lines, wherein each main gate line is not directly coupled to any sub gate line; and a plurality of pixels each controlled by a corresponding main gate line among the N main gate lines and a corresponding sub gate line among the N sub gate lines;

a first dummy shift register set;

a second dummy shift register set;

a third dummy shift register sets;

a fourth dummy shift register set, wherein each dummy shift register sets includes m dummy shift registers;

a first bi-directional shift register set coupled between the first dummy shift register set and the second dummy shift register set and including L bi-directional shift registers configured to drive the M main gate lines, wherein a first bi-directional shift register in the first bi-directional shift register set is coupled to the first dummy shift register set, an $L^{th}$ bi-directional shift register in the first bi-directional shift register set is coupled to the second dummy shift register set, an output end of a $k^{th}$bi-directional shift register in the first bi-directional shift register set is directly coupled to a $(k+m)^{th}$ main gate line which is coupled to an input end of a $(k+1)^{th}$ bi-directional shift register in the first bi-directional shift register set;

a second bi-directional shift register set coupled between the third dummy shift register set and the fourth dummy shift register set and including L bi-directional shift registers configured to drive the M sub gate lines, wherein a first bi-directional shift register in the second bi-directional shift register set is coupled to the third dummy shift register set, an $L^{th}$ bi-directional shift register in the second bi-directional shift register set is coupled to the fourth dummy shift register set, an output end of a $k^{th}$ bi-directional shift register in the second bi-directional shift register set is directly coupled to a $(k+m)^{th}$ sub gate line which is coupled to an input end of a $(k+1)^{th}$ bi-directional shift register in the second bi-directional shift register set; and a first directional start pulse signal generator coupled to the first bi-directional shift register in the first bi-directional shift register set and configured to enable a (1+m)th main gate line by outputting a first start pulse signal, and coupled to the (1+m−c)th dummy shift register in the third dummy shift register set and configured to enable (1+m−c)th sub gate line by outputting the first start pulse signal.

2. The display device of claim 1 further comprising:

a second directional start pulse signal generator coupled to the Lth bi-directional shift register in the first bi-directional shift register set for enabling an (L+m)th main gate line by outputting a second start pulse signal.

3. The display device of claim 2 wherein the second directional start pulse signal generator is coupled to a $c'^{th}$ dummy shift register in the fourth dummy shift register set for enabling an $(m+L+c')^{th}$ sub gate line by outputting the second start pulse signal, wherein $m \geqq c'$.

4. The display device of claim 1 further-comprising:

a second directional start pulse signal generator coupled to an $a^{th}$ dummy shift register in the second dummy shift register set for enabling an $(m+L+a)^{th}$ main gate line by outputting a second start pulse signal, wherein $m \geqq a$.

5. The display device of claim 4 wherein the second directional start pulse signal generator is coupled to the $(a+c')^{th}$ dummy shift register in the fourth dummy shift register set for enabling an $(m+L+a+c')^{th}$ sub gate line by outputting the second start pulse signal, wherein $m \geqq a+c'$.

6. The display device of claim 3 wherein c=c'.

7. The display device of claim 5 wherein c=c'.

8. The display device of claim 2 wherein the second directional start pulse signal generator is a reverse-scan start pulse signal generator.

9. The display device of claim 4 wherein the second directional start pulse signal generator is a reverse-scan start pulse signal generator.

10. The display device of claim 1 wherein the first directional start pulse signal generator is a forward-scan start pulse signal generator.

11. The display device of claim 1 wherein each dummy shift register set includes at least one uni-directional shift register.

12. The display device of claim 1 wherein each dummy shift register set includes at least one bi-directional shift register.

13. The display device of claim 1 wherein an $(L+m)^{th}$ main gate line is coupled an input end of a first dummy shift register in the second dummy shift register set.

14. A display device comprising:

a display panel having:

N main gate lines and N sub gate lines, wherein each main gate line is not directly connected to any sub gate line; and a plurality of pixels each controlled by a corresponding main gate line among the N main gate lines and a corresponding sub gate line among the N sub gate lines;

a first dummy shift register set;

a second dummy shift register set;

a third dummy shift register set;

a fourth dummy shift register set, wherein each dummy shift register set includes m dummy shift registers;

a first bi-directional shift register set coupled between the first dummy shift register set and the second dummy shift register set and including L bi-directional shift registers configured to drive the M main gate lines, wherein a first bi-directional shift register in the first bi-directional shift register set is coupled to the first dummy shift register set, an $L^{th}$ bi-directional shift register in the first bi-directional shift register set is coupled to the second dummy shift register set, an output end of a $k^{th}$ bi-directional shift register in the first bi-directional shift register set is directly coupled to a $(k+m)^{ht}$ main 1 gate line which is coupled to an input end of a $(k+1)^{th}$ bi-directional shift register in the first bi-directional shift register set;

a second bi-directional shift register set coupled between the third dummy shift register set and the fourth dummy shift register set and including L bi-directional shift registers configured to drive the M main gate lines, wherein a first bi-directional shift register in the second set of bi-directional shift registers is coupled to the third dummy shift register set, an $L^{th}$ bi-directional shift register in the second bi-directional shift register set is coupled to the fourth dummy shift register set, an output end of a $k^{th}$ bi-directional shift register in the second set of bi-directional shift registers is directly coupled to a $(k+m)^{th}$ sub gate line which is coupled to an input end of a $(k+1)^{th}$ bi-directional shift register in the second bi-directional shift register set; and a first directional start pulse signal generator coupled to a $j^{th}$ bi-directional shift register in the first bi-directional shift register set and configured to enable a $j^{th}$ main gate line by outputting a first start pulse signal, and coupled to a $(j-c)^{th}$ dummy shift register in the third dummy shift register set and configured to enable a $(j-c)^{th}$ sub gate line by outputting the first start pulse signal, wherein $N>L>k$, $m \geqq j>c$, and $j \neq 1$.

15. The display device of claim 14 further comprising:

a second directional start pulse signal generator coupled to the Lth bi-directional shift register in the first bi-directional shift register set for enabling an (L+m)th main gate line by outputting a second start pulse signal.

16. The display device of claim 15 wherein the second directional start pulse signal generator is coupled to a $c'^{th}$ dummy shift register in the fourth dummy shift register set for enabling an $(m+L+c')^{th}$ sub gate line by outputting the second start pulse signal, wherein $m \geqq c'$.

17. The display device of claim 14 further comprising:

a second directional start pulse signal generator coupled to an $a^{th}$ dummy shift register in the second dummy shift register set for enabling an $(m+L+a)^{th}$ main gate line by outputting a second start pulse signal, wherein $m \geqq a$.

18. The display device of claim 17 wherein the second directional start pulse signal generator is coupled to the $(a+c')^{th}$ dummy shift register in the fourth dummy shift register set for enabling an $(m+L+a+c')^{th}$ sub gate line by outputting the second start pulse signal, wherein $m \geqq a+c'$.

19. The display device of claim 16 wherein $c=c'$.

20. The display device of claim 18 wherein $c=c'$.

21. The display device of claim 15 wherein the second directional start pulse signal generator is a reverse-scan start pulse signal generator.

22. The display device of claim 17 wherein the second directional start pulse signal generator is a reverse-scan start pulse signal generator.

23. The display device of claim 14 wherein the first directional start pulse signal generator is a forward-scan start pulse signal generator.

24. The display device of claim 14 wherein each dummy shift register set includes at least one uni-directional shift register.

25. The display device of claim 14 wherein each dummy shift register set includes at least one bi-directional shift register.

26. The display device of claim 1 wherein an (L+m)th main gate line is coupled an input end of a first dummy shift register in the second dummy shift register set.

* * * * *